US009895043B2

(12) United States Patent
Noriega et al.

(10) Patent No.: US 9,895,043 B2
(45) Date of Patent: Feb. 20, 2018

(54) METHOD OF USING HIGH VELOCITY WATER TO REMOVE PUDDLING IN A DISHWASHER

(71) Applicant: Whirlpool Corporation, Benton Harbor, MI (US)

(72) Inventors: Alvaro Vallejo Noriega, Saint Joseph, MI (US); Harsh R. Mondkar, Pune (IN); Kevin Green, Ann Arbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/208,730

(22) Filed: Jul. 13, 2016

(65) Prior Publication Data

US 2017/0055799 A1 Mar. 2, 2017

Related U.S. Application Data

(60) Provisional application No. 62/210,090, filed on Aug. 26, 2015.

(51) Int. Cl.

| | |
|---|---|
| ***B08B 9/20*** | (2006.01) |
| ***A47L 15/00*** | (2006.01) |
| ***A47L 15/42*** | (2006.01) |
| ***A47L 15/50*** | (2006.01) |
| ***A47L 15/22*** | (2006.01) |
| ***A47L 15/16*** | (2006.01) |

(52) U.S. Cl.

CPC ..... *A47L 15/0005* (2013.01); *A47L 15/0084* (2013.01); *A47L 15/16* (2013.01); *A47L 15/22* (2013.01); *A47L 15/4261* (2013.01); *A47L 15/4285* (2013.01); *A47L 15/4287* (2013.01); *A47L 15/4297* (2013.01); *A47L 15/505* (2013.01); *A47L 15/507* (2013.01); *A47L 2601/02* (2013.01)

(58) Field of Classification Search

CPC .. A47L 15/0005; A47L 15/0084; A47L 15/16; A47L 15/22; A47L 15/4261; A47L 15/4285; A47L 15/4287; A47L 15/4297; A47L 15/505; A47L 15/507; A47L 2601/02

USPC ..... 134/25.2

See application file for complete search history.

(56) References Cited

U.S. PATENT DOCUMENTS

| | | | | |
|---|---|---|---|---|
| 3,496,949 A * | 2/1970 | Mercer | A47L 15/23 | 134/179 |
| 4,011,997 A | 3/1977 | Klimas | | |
| 4,368,747 A * | 1/1983 | Taylor | A47L 15/0089 | 134/138 |
| 7,887,642 B2 | 2/2011 | Jerg et al. | | |

(Continued)

FOREIGN PATENT DOCUMENTS

GB 569906 A 6/1945

OTHER PUBLICATIONS

Infoplease, "Bernoulli's Principle", pp. 1-4, Apr. 30, 2017.*

*Primary Examiner* — Sharidan Carrillo

(74) *Attorney, Agent, or Firm* — McGarry Bair PC

(57) ABSTRACT

A method of washing dishes in an automated dishwasher utilizing a high velocity sprayer and high velocity spray phase for forcibly spraying water from concavities on washed dishes or utensils in which liquid can puddle in the cavities of the dishes or utensils during previous washing or rinsing cycles.

10 Claims, 10 Drawing Sheets

(56) References Cited

U.S. PATENT DOCUMENTS

| | | | | |
|---|---|---|---|---|
| 8,528,574 | B2 | 9/2013 | Jerg et al. | |
| 2003/0140947 | A1* | 7/2003 | Han | A47L 15/4289 134/18 |
| 2006/0260649 | A1* | 11/2006 | Lee | A47L 15/0049 134/18 |
| 2011/0265827 | A1* | 11/2011 | Heissler | A47L 15/0026 134/25.2 |
| 2012/0285495 | A1* | 11/2012 | Pyo | A47L 15/4282 134/198 |
| 2012/0298598 | A1* | 11/2012 | Ennen | A47L 15/0034 211/41.8 |
| 2014/0209120 | A1* | 7/2014 | Allen | A47L 15/0049 134/18 |
| 2017/0055799 | A1* | 3/2017 | Noriega | A47L 15/0005 |

* cited by examiner

METHOD OF USING HIGH VELOCITY WATER TO REMOVE PUDDLING IN A DISHWASHER

CROSS-REFERENCE TO RELATED APPLICATIONS

The present application claims the benefit of U.S. Provisional Patent Application No. 62/210,090, filed Aug. 26, 2015, which is incorporated by reference herein in its entirety.

BACKGROUND OF THE INVENTION

Automatic dishwashers for use in a typical household include a tub defining a treating chamber and a spraying system for recirculating liquid throughout the tub to remove soils from the dishes and utensils. Two common configurations are a door-type, where a pivoting door provides access to a treating chamber where dishes are washed or a drawer-type where a drawer provides access to the as well as defining a major portion of the treating chamber. In either configuration, a rack for holding dishes to be cleaned is typically provided within the treating chamber. Dishes, especially open-top containers such as glasses, bowls, cups, etc., are placed in the rack with the open-top down so that the bottoms of the containers are facing up. The bottoms often provide a surface on which liquid used during the cleaning process can collect and forms puddles. The puddles of liquid can be great enough that the liquid is not evaporated during the drying phase of the cycle of operation. Upon the removal of the dish from the treating chamber, the puddled liquid can spill and wet other dishes, which is undesirable by most consumers.

BRIEF DESCRIPTION OF THE INVENTION

In one aspect, the invention relates to a method of treating dishes according to a cycle of operation in a dishwasher having a treating chamber in which is located a dish rack on which the dishes are received for treatment. The method includes: (1) recirculating wash liquid in the treating chamber by emitting a first liquid from a sprayer at a first speed to form a normal-speed spray during a first phase of the cycle of operation, and (2) emitting a second liquid from a sprayer located above the dish rack at a second speed, greater than the first speed, to form a high-speed spray during a second phase of the cycle of operation. The high-speed spray reduces puddle of wash liquid formed on the dishes in the dish rack from the normal-speed spray during the first phase.

In another aspect, the invention relates to a dishwasher for treating dishes according to a cycle of operation. The dishwasher includes a tub partially defining a treating chamber and a dish rack received within the treating chamber. The dishwasher further includes a first sprayer located within the treating chamber that emits a first liquid at a first speed to form a normal spray speed. Further still, the dishwasher includes a second sprayer located within the treating chamber and above the dish rack and emits a second liquid at a second speed, greater than the first speed, downwardly onto the dish rack to form a high-speed spray.

DESCRIPTION OF EMBODIMENTS OF THE INVENTION

Figure 1:
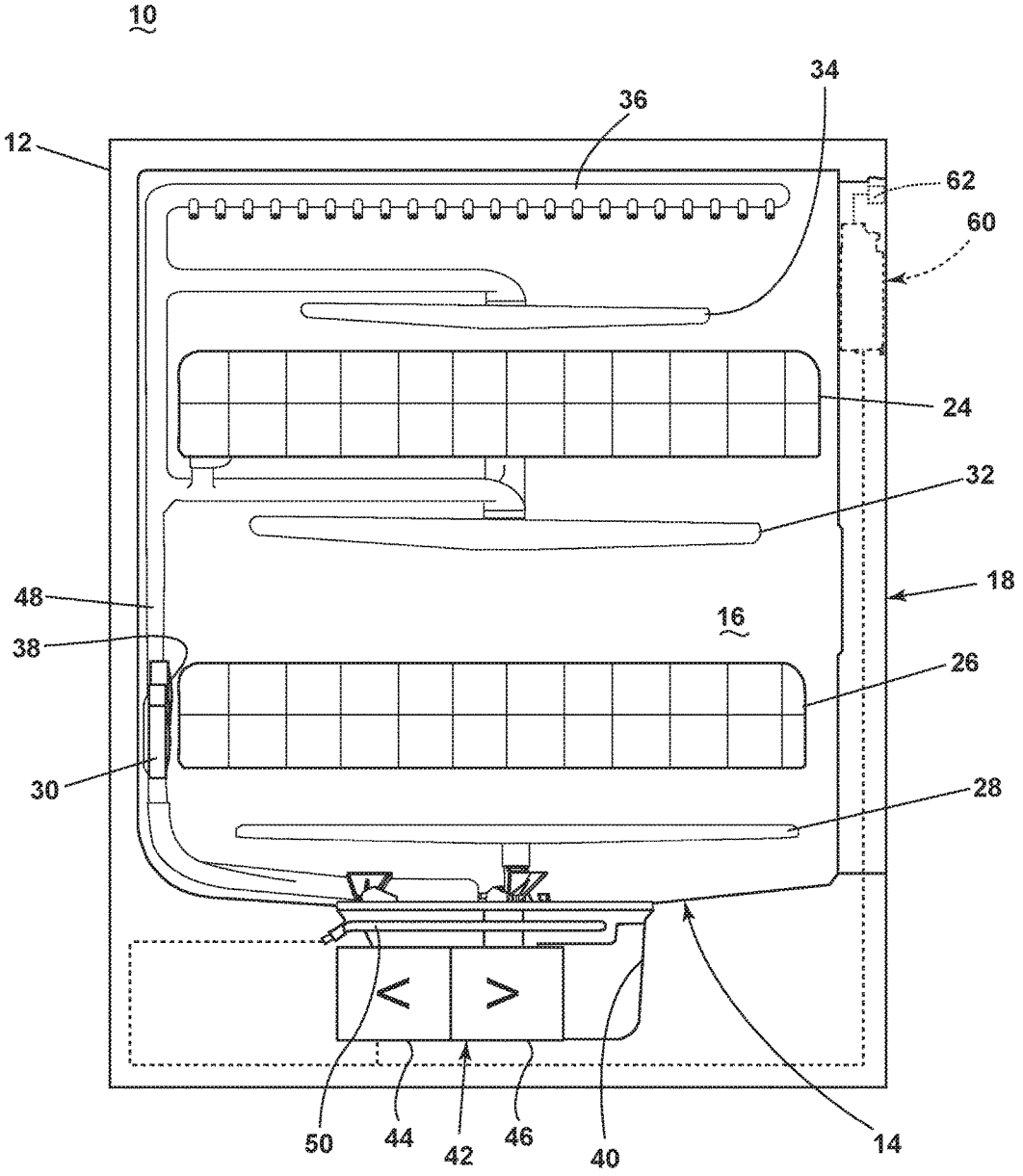
FIG. 1 illustrates a schematic, cross-sectional view of a dishwasher including a high-speed sprayer according to an embodiment of the invention.

As used herein, the term "cycle" refers to one operational cycle, such as a wash or rinse cycle, while "phase" relates to a portion of the cycle. For example, a basic treating cycle for cleaning dishes comprises a wash phase, where a wash liquid of at least water and detergent is sprayed onto the dishes, followed by a rinse phase, where clean water or water with an anti-spotting agent is sprayed onto the dishes, and a dry phase where the dishes are dried, which can include a heated drying. Other phases can be added or removed from the basic cycle.

As used herein, the term "normal spray" or "normal-speed spray" can refer to a spray of liquid having a velocity, pressure, or flow rate typical to a standard dishwashing unit, sufficient to properly treat articles within the dishwasher. As used herein, the term "high-speed" or "high-speed spray" can refer to a liquid spray having a velocity, pressure, or flow rate greater than that of the "normal spray" or "normal-speed spray."

In one example, the "high-speed spray" can include a velocity of 1.5-2.5 meters per second (m/s). Additionally, the term "normal spray" or "normal-speed spray" refers to a liquid spray comprising a velocity being less than a respective velocity for the high-speed spray. As is understood, any overlap between the ranges of the liquid speed of the "normal spray" and the "high-speed spray" can necessitate that any speed value for the "high-speed spray" include a greater value than that of the "normal spray" in any one embodiment. Further, "high-speed" or "high-speed spray" refers to a liquid spray pressure, velocity, or flow rate sufficient to shoot, blast, splash, or otherwise wholly or partially remove a quantity of puddled liquid from a concavity, such that treatment by "high-speed(s)" or the "high-speed spray" decreases the volume of residual puddled liquid in the concavity.

In another example, the values for the "normal spray" and "high-speed spray" can increase or decrease depending on the system in which the method or apparatus is implemented. For example, as the distance from a spray apparatus to a treated object increases or decreases, the liquid pressure, speed, or flow rate can increase or decrease in relation to that distance in order to effectively treat the object. As such, spray velocities can be greater or lesser than 1.5-2.5 m/s based upon the architecture of the particular appliance. Additionally, values for pressure, speed, or flow rate can increase or decrease based upon a nozzle width or shape as well as system water pressure, in non-limiting examples.

Furthermore, as used herein, "liquid" or "wash liquid" can refer to any liquid emitted, sprayed, or utilized within a dishwasher during a cycle of operation. Examples of such a liquid can include water, treating chemistries such as detergent, or a mixture of water and treating chemistries.

Further still, as used herein, "dish" or "dishes" can refer to one or more generic article placed in a dishwasher for treatment during a cycle of operation. Examples of such a "dish" or "dishes" can include a plate, bowl, cup, silverware, cooking utensils, glassware, bakeware, cooking ware, pots, pans, kitchenware, or any other article which may be desirable to treat according to a cycle of operation in the dishwasher, in non-limiting examples.

In FIG. 1, an automated dishwasher 10 according to an exemplary first embodiment is illustrated. The dishwasher 10 shares many features of a conventional automated dishwasher, which is not be described in detail herein except as necessary for a complete understanding of the invention. A chassis 12 can define an interior of the dishwasher 10 and can include a frame, with or without panels mounted to the frame. An open-faced tub 14 can be provided within the chassis 12 and can at least partially define a treating chamber 16 for washing dishes. A cover such as a door assembly 18 can be movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 can secure to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 is permitted when the door assembly 18 is open. It should be further appreciated that the cover can comprise a drawer-type door assembly (not shown), where the treating chamber 16 can be pulled out from the chassis 12 as the door is pulled open, providing user access to the treating chamber 16.

Dish holders, illustrated in the form of upper and lower dish racks 24, 26, are located within the treating chamber 16 and receive dishes for washing. The upper and lower dish racks 24, 26 can be in the treating chamber, having the upper dish rack 24 positioned above the lower dish rack 26. The upper and lower racks 24, 26 are typically mounted for slidable movement in and out of the treating chamber 16 for ease of loading and unloading. Other dish holders can be provided, such as a silverware basket. Where the cover comprises a drawer-type door assembly, one or more upper or lower racks 24, 26 located within the treating chamber 16 can pull out from the chassis 12 as the drawer pulls open.

A spray system is provided for spraying liquid in the treating chamber 16 and is provided in the form of one or more sprayers or spray assemblies. The spray system as illustrated includes a first lower sprayer 28, a second lower sprayer 30, a mid-level sprayer 32, an upper sprayer 34, and a high-speed sprayer 36. The high-speed sprayer 36 is shown as situated above the upper rack 24, but can also mount, without limitation, to the top of the tub 14, to the sidewalls of the tub 14, under the upper rack 24, or to the bottom of the upper rack 24. The upper sprayer 34, mid-level sprayer 32 and first lower sprayer 28 are located, respectively, above the upper rack 24, beneath the upper rack 24, and beneath the lower rack 26 and are illustrated as rotating spray arms. The second lower sprayer 30 is illustrated as being located adjacent the lower dish rack 26 toward the rear of the treating chamber 16. The second lower sprayer 30 is illustrated as including a vertically oriented distribution header or spray manifold 38. Such a spray manifold is set forth in detail in U.S. Pat. No. 7,594,513, issued Sep. 29, 2009, and titled "Multiple Wash Zone Dishwasher," which is incorporated herein by reference in its entirety. In variations, the dishwasher 10 can contain more or less sprayer, and one can appreciate that some sprayer 28, 30, 32, 34 can be optional.

A recirculation system is provided for recirculating liquid from the treating chamber 16 to the spray system. The recirculation system can include a sump 40 and a pump assembly 42. The sump 40 collects the liquid sprayed in the treating chamber 16 and is formed by a sloped or recess portion of a bottom wall of the tub 14. The pump assembly 42 includes both a drain pump 44 and a recirculation pump 46. The drain pump 44 draws liquid from the sump 40 and pumps the liquid out of the dishwasher 10 to a household drain line (not shown). The recirculation pump 46 draws liquid from the sump 40 and the liquid can be simultaneously or selectively pumped through a supply tube 48 to each of the sprayers 28, 30, 32, 34, 36, for selective spraying. While not shown, a liquid supply system can include a water supply conduit coupled with a household water supply for supplying water to the treating chamber 16. A heating system including a heater 50 can be located within the sump 40 for heating the liquid contained in the sump 40 or for heating the air within the treating chamber 16.

A controller 60 can also be included in the dishwasher 10, which can be operably coupled with various components of the dishwasher 10 to implement a cycle of operation. The controller 60 can be located within the door 18 as illustrated, or it can alternatively be located somewhere within the chassis 12. The controller 60 can also be operably coupled with a control panel or user interface (UI) 62 for receiving user-selected inputs and communicating information to the user. The UI 62 can include operational controls such as dials, lights, switches, and displays enabling a user to receive information and input commands, such as a cycle of operation, to the controller 60.

Figure 2:
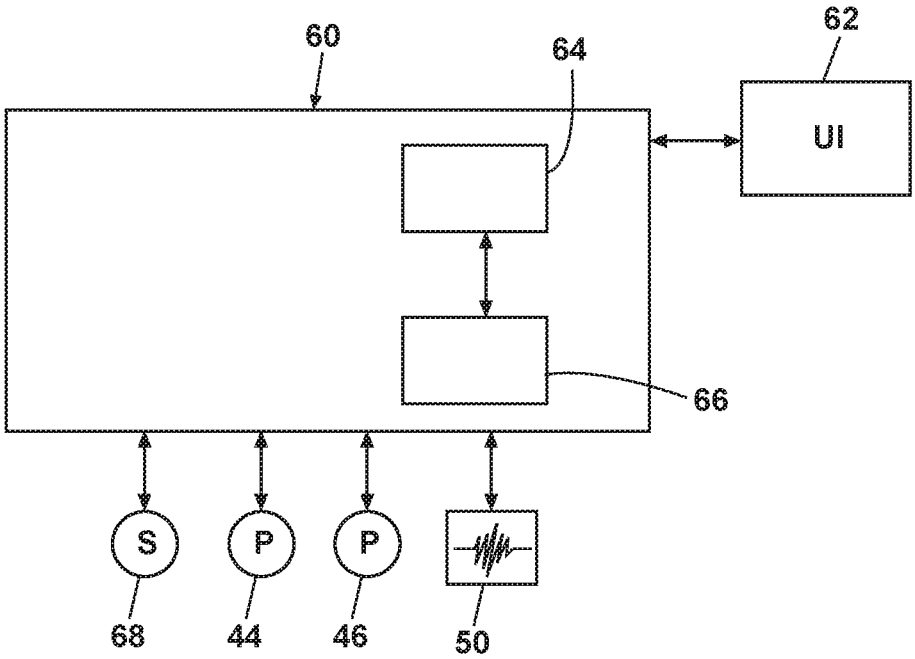
FIG. 2 illustrates a schematic view of a controller of the dishwasher of FIG. 1.

As illustrated schematically in FIG. 2, the controller 60 can communicatively couple to the heater 50 for heating the wash liquid during a cycle of operation, the drain pump 44 for draining liquid from the treating chamber 16, and the recirculation pump 46 for recirculating the wash liquid during the cycle of operation. The controller 60 can be provided with a memory 64 and a central processing unit (CPU) 66. The memory 64 can be used for storing control software that can be executed by the CPU 66 in completing a cycle of operation using the dishwasher 10 and any additional software. For example, the memory 64 can store one or more pre-programmed cycles of operation that can be selected by a user and completed by the dishwasher 10. The controller 60 can also receive input from one or more sensors 68. Non-limiting examples of sensors that can be communicably coupled with the controller 60 include a temperature sensor and turbidity sensor to determine the soil load associated with a selected grouping of dishes, such as the dishes associated with a particular area of the treating chamber.

Figure 3:
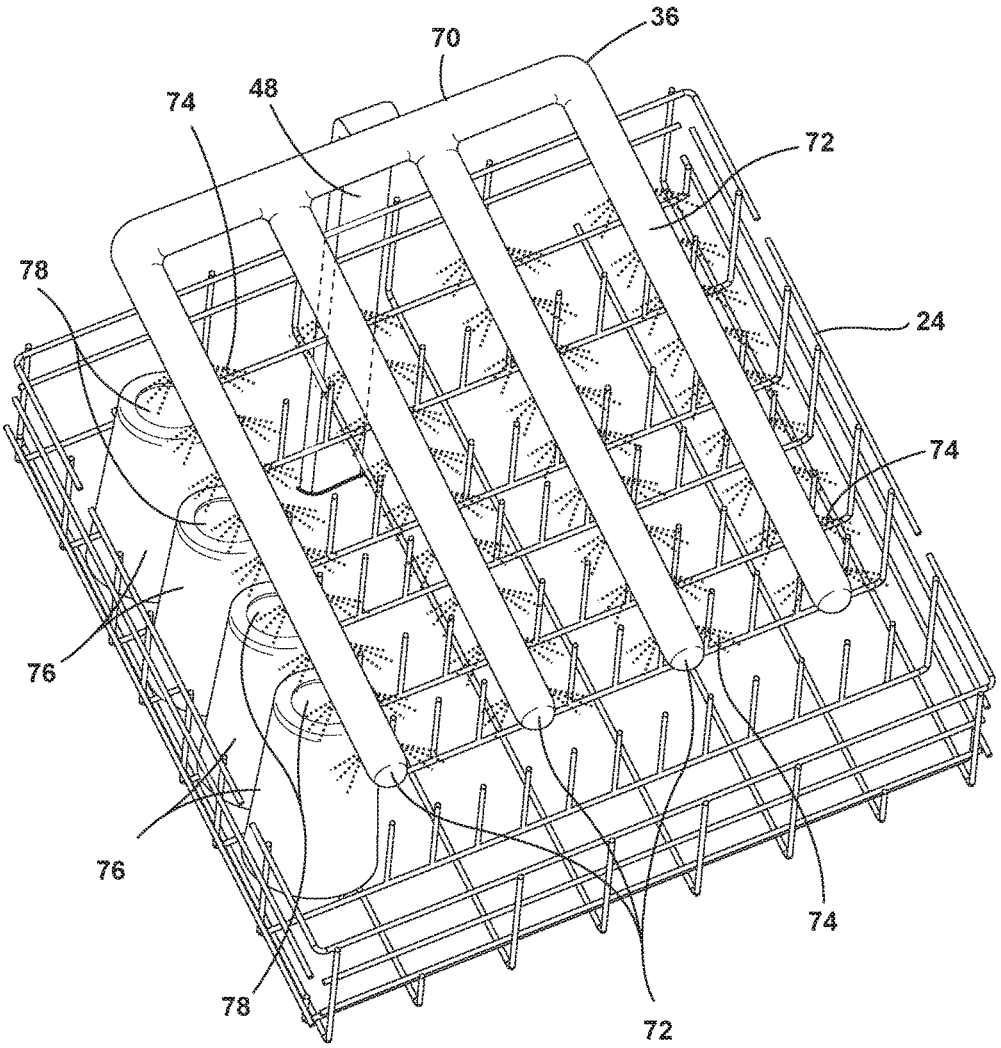
FIG. 3 illustrates a perspective top view of the high-speed sprayer of FIG. 1 above an isolated dish rack.

Turning to FIG. 3, the upper rack 24 is illustrated with the high-speed sprayer 36 positioned above the upper rack 24. The upper sprayer 34 is removed for clarity. The high-speed sprayer 36 includes a spray conduit 70 having four spray headers 72 extending over the upper rack 24. The spray headers 72 are supplied with a volume of wash liquid from the supply tube 48 and distributed through the spray conduit 70. The supplied wash liquid is sprayed as a high-speed spray liquid 74 from the headers 72. While four spray headers 72 are shown, any number of spray headers 72 are contemplated organized in any position or manner above the upper rack 24. A plurality of dishes 76 can be disposed within the upper rack 24. A concavity 78 can be formed in the dishes 76 facing the high-speed sprayer 36.

The upper rack 24, includes a bottom which can define an effective plane, typically substantially parallel to the surface upon which the dishwasher 10 rests. The liquid 74 is sprayed a direction forming an acute angle, being less than ninety-degrees, relative to the rack effective plane. Thus, it should be appreciated that the liquid 74 is sprayed having a spray direction at the dishes at an angle as opposed to directly at or orthogonal to the concavities 78. Spraying the liquid at the angle blasts the puddled liquid from the dishes 76, while preventing residual liquid from the high-speed sprayer 36 to leave residual puddling.

The spray headers 72 are organized in a manner such that liquid 74 sprayed from the high-speed sprayer 36 treats all dishes 76 on the upper dish rack 24. Thus, all dishes 76 having concavities 78 can be treated where puddling liquid can occur. In another example, the spray headers 72 can be disposed above only a portion of the rack 24 where dishes 76 having concavities 78 can be placed in the portion of the rack 24, to be treated by the spray headers 72. Thus, the user can particularly place dishes 76 with concavities 78 for treatment by the high-speed sprayer 36, while minimizing water usage among the entire rack 24.

Figure 4:
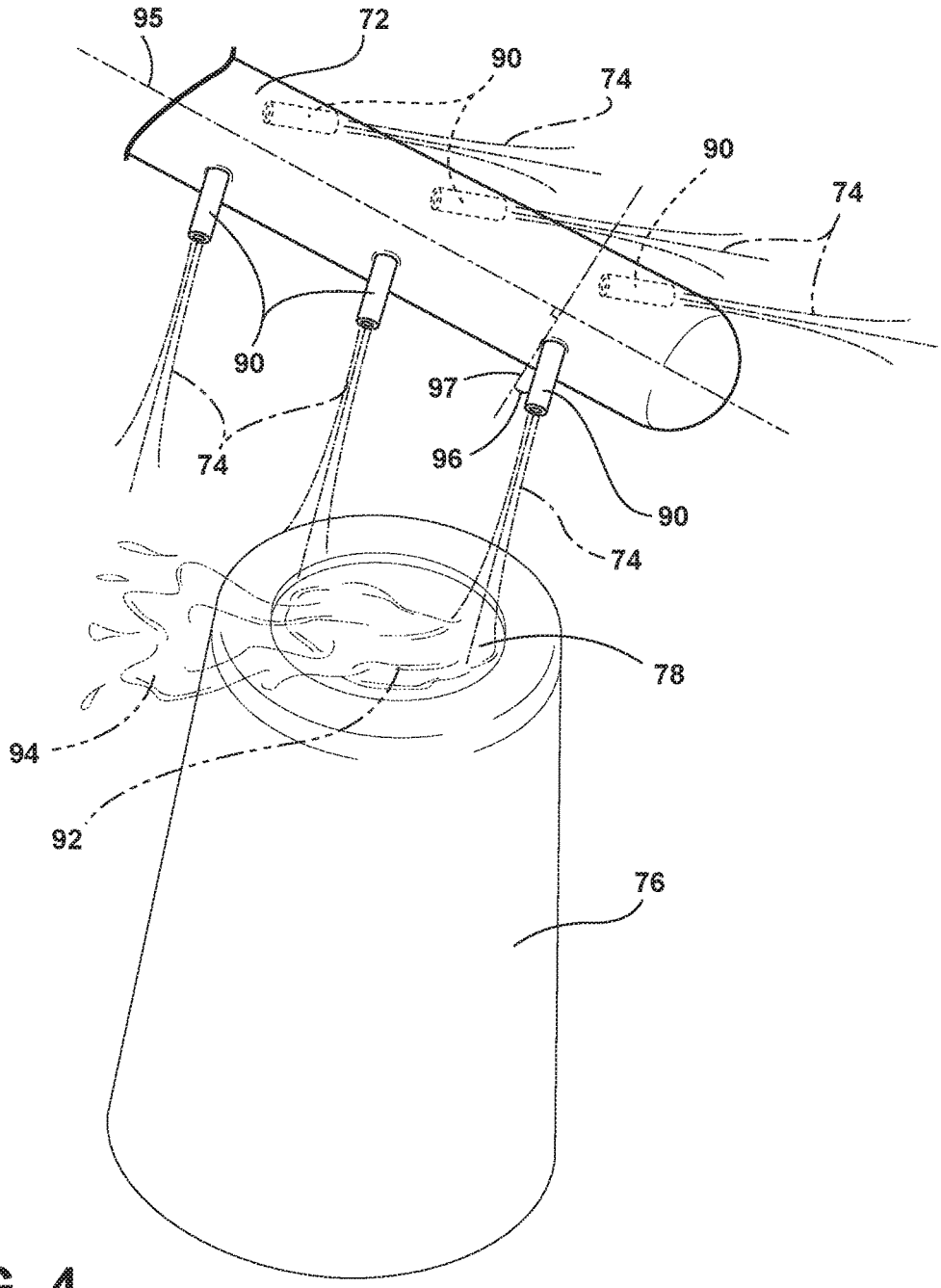
FIG. 4 illustrates a perspective view of a spray header of the high-speed sprayer of FIG. 3 blasting liquid from a dish.

In FIG. 4, the spray header 72 can comprise a plurality of spray openings in the form of nozzles 90. The nozzles 90 as shown are exemplary. In variations, the nozzles 90 can be of varying shapes, structures, or diameters designed to spray liquid at greater or lesser high-speeds, being a speed greater than that of a normal spray, in order to effectively remove puddled liquid from the dishes 76. The nozzles 90 can be straight, curved, or funnel-shaped in non-limiting examples. In different variations, nozzle diameter can increase or decrease to vary the velocity of the high-speed spray, which can depend on the distance from the high-speed sprayer 36 to the dishes 76 or anticipated distance from the dishes. Such an anticipated distance can be defined by labelling the rack 24 having dedicated sections, such as tall, medium, and short dishes to ensure effective treating based upon dish height.

It should be appreciated that the nozzles 90 can comprise one or more rows of nozzles 90 defined along one or more spray headers 72. The nozzles 90 or rows of nozzles 90, alternatively, can be selectively operated, only spraying a high-speed liquid 74 from one row or only one or some or the nozzles 90 at a time, in order to reduce the relative or cumulative amount of liquid flow during operation. As such, overall liquid consumption can be minimized as well as a reduction in local liquid pressures can be seen.

Any number or subset of nozzles 90 can be disposed along the spray header 72 at varying frequencies or angles, such that effective liquid removal. The spray header 72 can define a longitudinal axis 95 extending along the length of the header 72. A radial axis 97 can be defined extending orthogonal from the longitudinal axis 95. The nozzles 90 disposed at an angle 96 relative to the radial axis 97. The angle 96 can be any angle from 0 degrees to 90 degrees in any direction from the radial axis 97. For example, the angle can be defined by an exemplary nozzle 90 extending forward, rearward, upward or downward, or any combination thereof. It should be appreciated that adjacent nozzles 90 can be disposed at similar or different angles 96 relative to one another, such that particular treatment coverage can be achieved.

In one example, the high-speed spray liquid 74 can be sprayed at a downward angle 96 ranging from 25 degrees to 60 degrees relative to the a plane parallel to the longitudinal axis 95 defined by two or more spray headers 72. A lower downward angle 96, such as 25 degrees to 35 degrees, is optimal for removing puddled liquid 92, while leaving a minimal amount of residual liquid from the high-speed spray.

Residual liquid can collect as a puddle of liquid or puddled liquid 92 in the concavity 78 on the dishes 76. The liquid 74 is sprayed or blasted through the nozzles 90 at a high-speed toward the puddled liquid 92, resulting in a splashed liquid 94. The splashed liquid 94 removed from the concavities 78 by the high-speed liquid 74 and can fall or run to the bottom of the tub, where it can be removed or recirculated by the drain or recirculation pumps, respectively.

In operation, the sprayers 28, 30, 32, 34 other than the high-speed sprayer 36 can treat the dishes during a cycle of operation. During treatment by the other sprayers 28, 30, 32, 34, wash liquid can collect or puddle within the concavities 78 on the dishes 76. In order to remove such puddling, the spray headers 72 spray liquid 74 at the concavities 78 of the dishes 76 disposed within the upper rack 24 at a high-speed. The high-speed, for example, can be between 1.5-2.5 m/s, while other speeds are contemplated. The high-speed spray is a spray having a velocity greater than a spray speed of liquid sprayed from the other sprayers 28, 30, 32, 34 during wash and rinse phases. The high-speed spray liquid 74 can blast, splash, or otherwise remove and reduce the puddling on the dishes 76.

Figure 5:
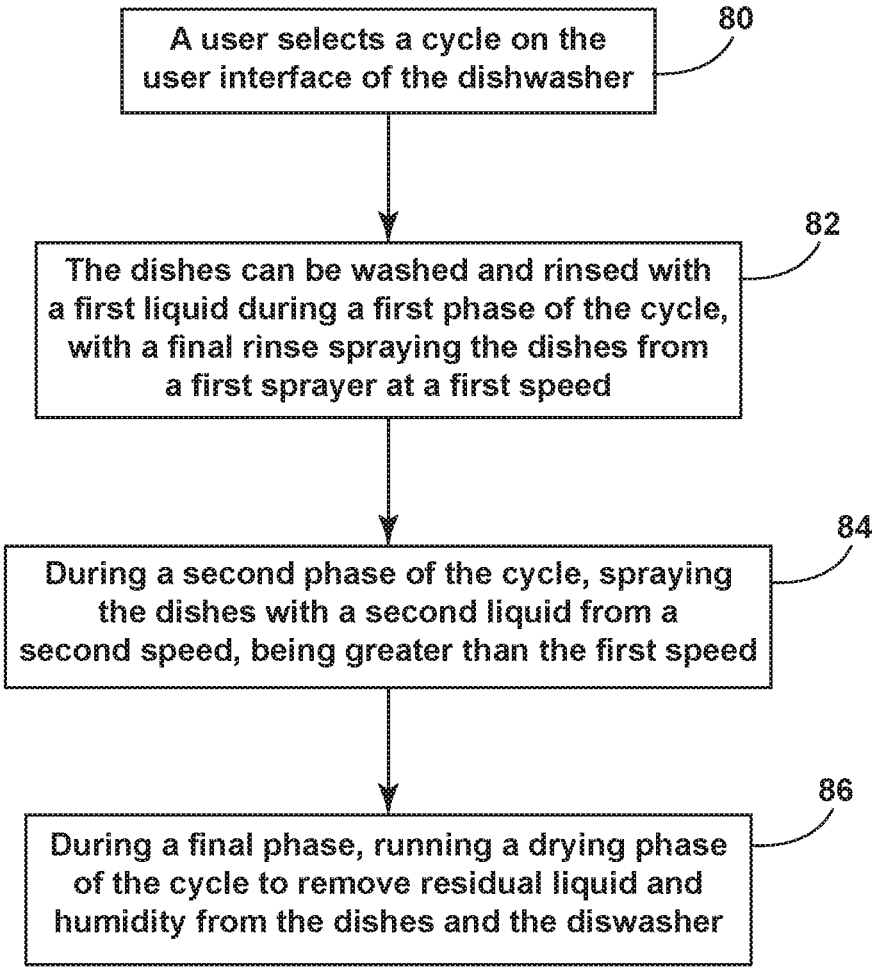
FIG. 5 illustrates a flow chart of the method of treating dishes using the high-speed sprayer of FIG. 1.

Referring to FIG. 5, a flow chart illustrates a method of treating dishes 76 according to a cycle of operation in a dishwasher 10 having the treating chamber 16 in which is located a dish rack 24 on which the dishes 76 are received for treatment. At 80, the method includes a user selecting a cycle of operation on the dishwasher user interface 62. Such a cycle of operation can include any cycle for treating the dishes 76 within the dishwasher 10. Examples of such cycles of operation can include, in non-limiting examples, standard wash, heavy wash, light wash, or pots and pans. The controller 60 within the user interface 62 operates the dishwasher 10 according to the cycle of operation. The cycle of operation generally includes one or more phases, including but not limited to, wash, rinse, high-speed spray, and dry phases.

At 82, the dishwasher 10 can wash and rinse the dishes 76 during a first phase of the cycle. An exemplary first phase can include a wash phase. At the end of the first phase, a final rinse can spray the dishes by emitting a first liquid from a first sprayer at a first speed, being a normal-speed spray. For example, the final rinse can include spraying the dishes 76 with water from the upper sprayer 34 at a normal spray speed. It should be understood that the first sprayer can comprise any normal sprayers 28, 30, 32, 34 and the first liquid can comprise, without limitation, water, detergent, or a mix thereof. Any dishes having a concavity tend to collect the first liquid from the normal-speed spray, developing puddled liquid in the concavities.

At 84, a second phase of the cycle can begin. The second phase, for example, can include a high-speed rinse phase. A second liquid, such as water, is emitted at the dishes 76 from a second sprayer located above the dish rack 24. The second sprayer can be the high-speed sprayer 36. The second sprayer shoots or blasts liquid at a second speed to form a high-speed spray, being a greater speed than the speed of the normal-speed spray at step 82. The high-speed spray from the second sprayer splashes puddled liquid from the concavities in the dishes, reducing puddles of wash liquid formed on the dishes, leaving little or no residual liquid behind.

At 86, during a final phase, which can comprise a drying phase, the heater can remove residual liquid and humidity from the dishes and the concavities thereon. As is appreciated, the residual liquid in the concavities is minimized, and is now capable of removal with a dry phase utilizing a heater, otherwise incapable of removing the entire volume of puddled liquid in the concavities.

It should be understood that the first and second sprayers as described in FIG. 5 can be the same or different sprayers. As the same sprayer, it would be capable of emitting both a normal and high-speed sprays. As different sprayers, the normal-speed spray and the high-speed spray are emitted from different sprayers.

Figure 6:
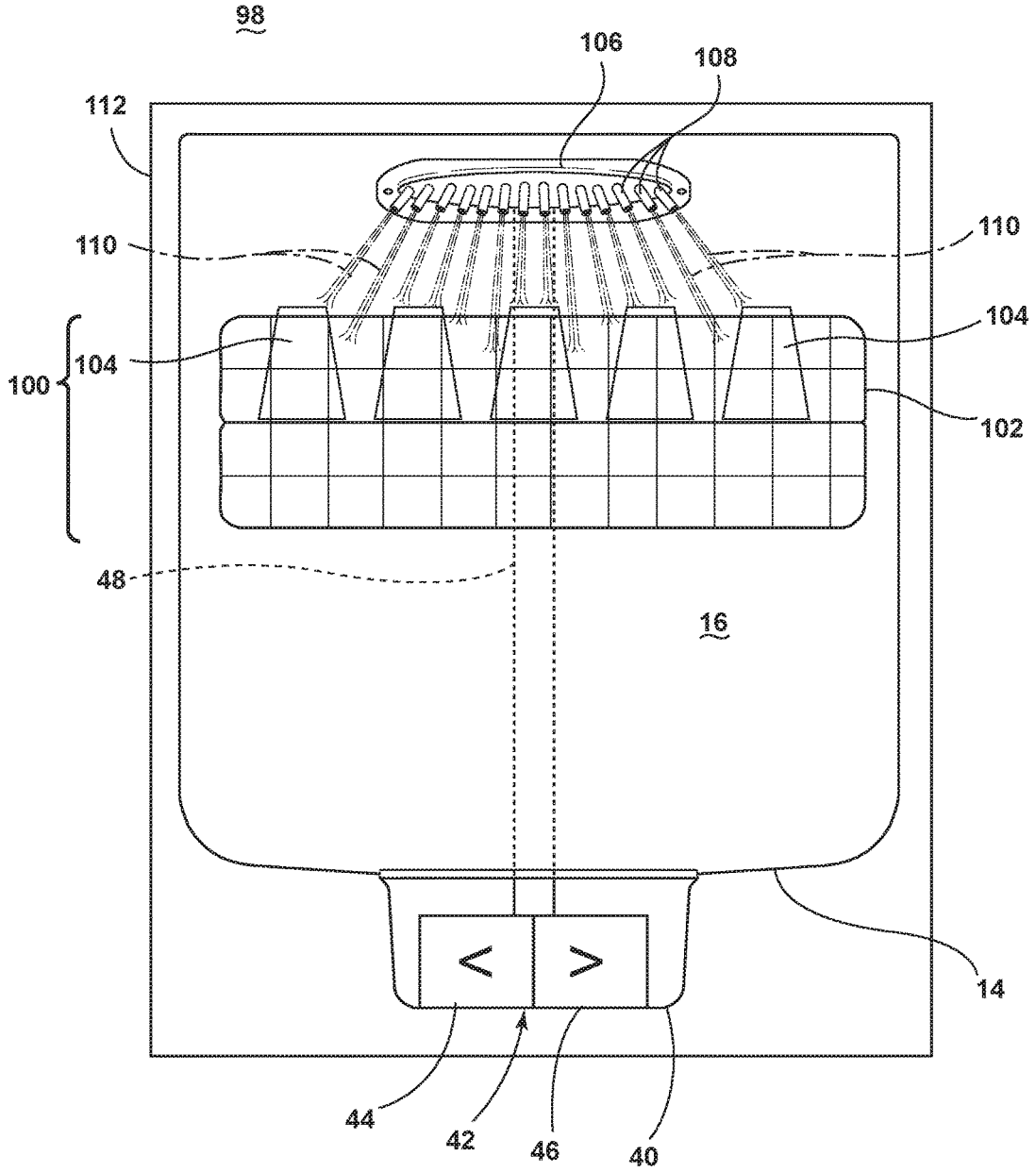
FIG. 6 illustrates a schematic, front view of a dishwasher with a dedicated high-speed sprayer according to another embodiment of the invention.

Referring now to FIG. 6, an alternative dishwasher 98 is illustrated and can include general dishwasher components similar to the dishwasher 10 as discussed in FIG. 1 and like elements will be identified with the same reference numerals. The dishwasher 98 can further include an upper rack 100 with an integrated dedicated rack 102. A plurality of dishes 104 can be placed within the dedicated rack 102 for treatment during a cycle of operation by the dishwasher 98. The dedicated rack 102 can be molded or machined as part of the upper rack 100 or can be a separate insertable rack.

A dedicated high-speed sprayer 106 can mount to the tub 14. For example, the dedicated high-speed sprayer 106 can mount to the sidewalls, back walls, or top walls of the tub 14 based upon the particular needs of the dishwasher 98 or placement of the dedicated rack 102. The dedicated high-speed sprayer 106 includes a plurality of openings shown as nozzles 108. The pump assembly 42 fluidly couples to the dedicated high-speed sprayer 106 via the supply tube 48. A liquid 110 pumped from the pump assembly 42 to the dedicated high-speed sprayer 106 and is sprayed or blasted at a high-speed through the nozzles 108 towards the tops of the dishes 104 on the upper rack 100 or the dedicated rack 102.

Figure 7:
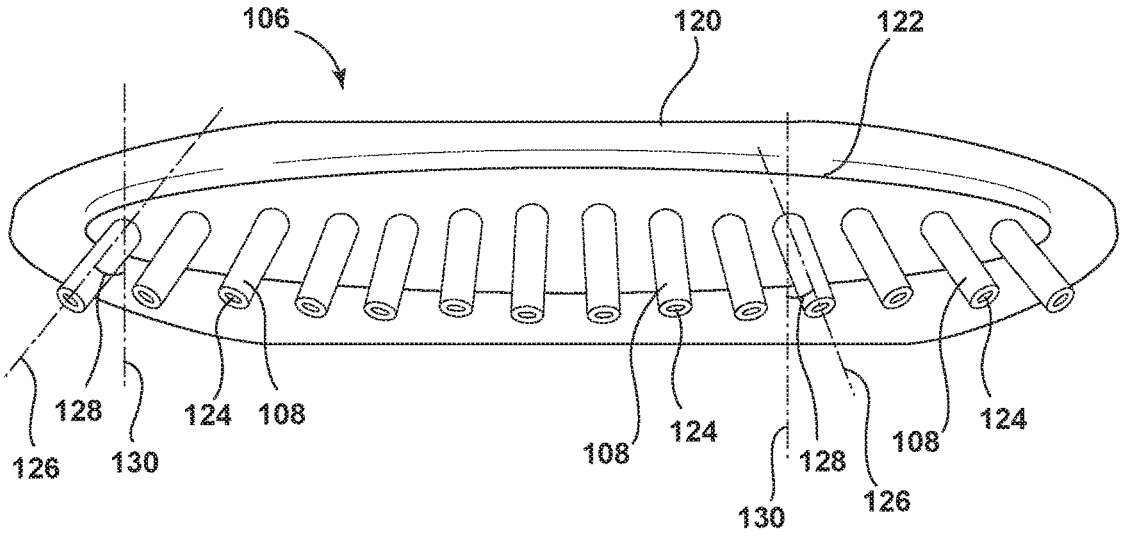
FIG. 7 illustrates a front view of the dedicated high-speed sprayer of FIG. 6.

In FIG. 7, the dedicated high-speed sprayer 106 can comprise a rigid body 120. The dedicated high-speed sprayer 106 can mount to the tub 14 such as by fastening or welding. A nozzle manifold 122 mounts to the front of the body 120 facing the treating chamber 16 of the dishwasher 98, or can be integrated with the body 120. The nozzle manifold 122 includes one or more nozzles 108, each having a nozzle conduit 124 with a diameter designed to spray liquid at a speed or pressure greater than that of the sprayers 28, 30, 32, 34 used for standard wash and rinse phases. The nozzles 108 can be arranged such that liquid can be directed or angled in a downward manner, relative to a plane extending from the dedicated high-speed sprayer 106, parallel to a top wall or bottom wall of the tub 14. The nozzles 108 each can further define a longitudinal nozzle axis 126. The nozzles 108 can be angled such that an angle 128 is defined between the nozzle axis 126 and a wall axis 130 extending orthogonal to the tub 14 on which the dedicated high-speed sprayer 106 can be mounted. The nozzles 108 can be angled at the angle 128 such that the sprayed liquid 110 can cover the entire length of the dedicated rack 102 or any dedicated spray area without the sprayer 106 extending across the entire length of the rack 100.

Figure 8:
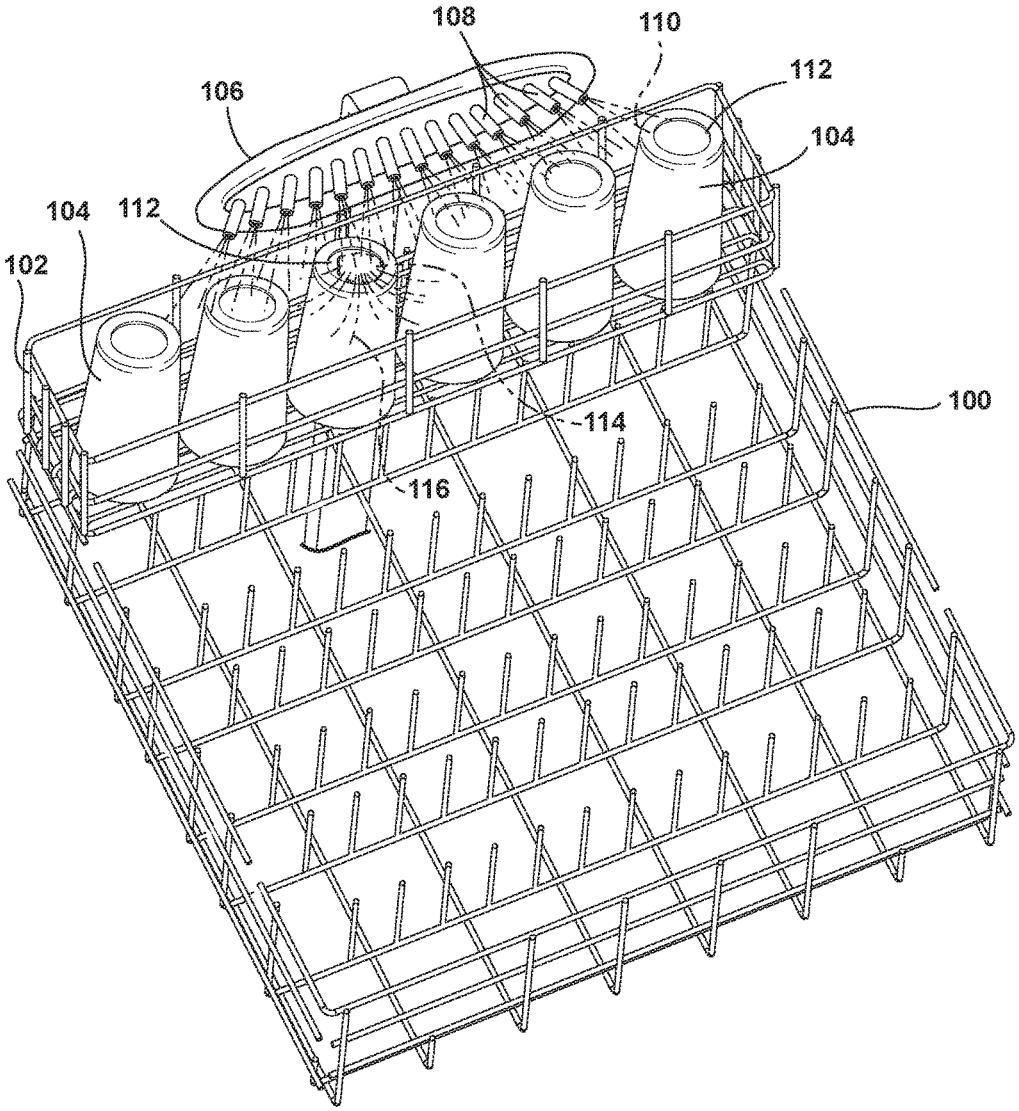
FIG. 8 illustrates a top perspective view of the dedicated high-speed sprayer of FIG. 6.

Referring to FIG. 8, the upper rack 100 and the dedicated rack 102 are integrated as a single unit and are positioned below and adjacent to the dedicated high-speed sprayer 106. Dishes 104 comprising a concavity 112 that are predisposed to collecting puddled liquid 114 are placed by a user in the dedicated rack 102. Puddled liquid 114, which collects in the concavities 112 during wash and rinse phases, are sprayed with liquid 110 from the dedicated high-speed sprayer 106 through the nozzles 108 at a high-speed, removing a quantity of puddled liquid 114 from the concavities 112 and creating splashed liquid 116. The high-speed, in one non-limiting example, can be 1.5-2.5 m/s. The splashed liquid 116 can fall to the bottom of the tub 14 for removal or recirculated via the drain pump or the recirculation pump, respectively.

In one exemplary variation, the dishwasher 98 can incorporate the dedicated high-speed sprayer 106 without the dedicated rack 102. Particular spray zones in the upper rack 100 covered by the dedicated high-speed sprayer 106 can be designated for dishes 104 that are predisposed to puddled liquid 114. These spray zones can be identified by color, rack architecture, or other indicia in non-limiting examples. Rack architecture can comprise a particular rack structure, which can be readily identifiable by a user as a spray zone.

The method of operation can be substantially similar to that of FIG. 5 as shown and described, where the second sprayer of step 84 includes the dedicated high-speed sprayer 106. As can be appreciated, the remaining steps 80, 82, 86 will remain the same.

Figure 9:
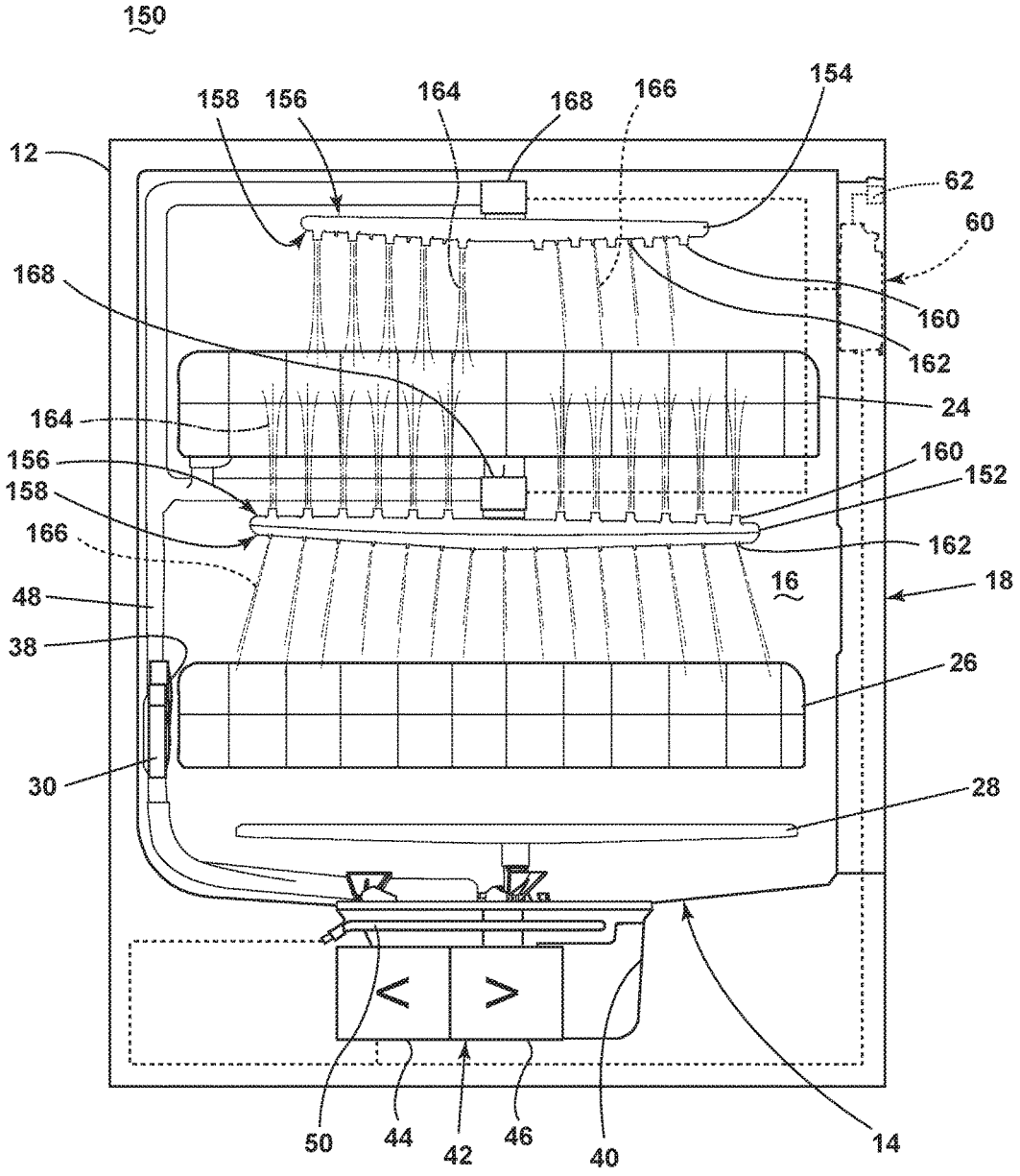
FIG. 9 illustrates a schematic, cross-sectional view of a dishwasher with a high-speed sprayer having combined normal and high-speed spray nozzles, illustrating two variations thereof in the exemplary dishwasher.

Turning now to FIG. 9, another exemplary dishwasher 150 is illustrated including two integrated sprayers. The dishwasher 150 can include general dishwasher components similar to the dishwasher 10 as discussed in FIG. 1 and like elements will be identified with the same reference numerals.

The dishwasher 150 can include an integrated mid-level sprayer 152 or an integrated upper sprayer 154, or both. The integrated sprayers 152, 154 include an integrated normal-speed sprayer and a high-speed sprayer. The integrated mid-level sprayer 152 and integrated upper sprayer 154, however, differently integrate the normal and high-speed sprayers, illustrating two separate variations. It should be appreciated that while both variations are illustrated within the dishwasher 150 in FIG. 9, the dishwasher 150 can include one or both of the sprayers 152, 154.

The integrated mid-level sprayer 152 includes an upper surface 156 and a lower surface 158. The integrated mid-level sprayer 152 can be a rotating arm assembly to cover the entirety of the racks 24, 26 above and below. The upper surface 156 includes a plurality of openings as normal nozzles 160. The normal nozzles 160 have a diameter adapted to spray a normal spray 164 at a normal-speed, common to standard wash and rinse phases. The normal nozzles 160 can wash or rinse the dishes on the upper rack 24 from below. The lower surface 158 includes a plurality of openings as high-speed nozzles 162, adapted to spray a high-speed spray 166 at a greater speed than that of the normal nozzles 160. The high-speed nozzles 162 can blast the high-speed spray 166 toward the lower rack 26 to remove puddling on lower rack dishes.

The integrated upper sprayer 154 contains both normal nozzles 160 and high-speed nozzles 162 disposed on the lower surface 158 having the upper surface 156 sealed. Both the normal nozzles 160 and the high-speed nozzles 162 are disposed along the entire lower surface 158 can spray the entire area of the upper rack 24. As such, the integrated upper sprayer 154 can be a rotating arm assembly. It should be understood that the integrated upper sprayer 154 as shown in FIG. 9, is simultaneously spraying both the normal-speed spray 164 and the high-speed spray 166. The illustration is only exemplary of the capability of the integrated upper sprayer 154. It should be understood that during operation only the normal nozzles 160 spraying a normal spray 164 or only the high-speed nozzles 162 spraying at a high-speed spray 166 can be operational at a time and are not operated simultaneously.

The nozzles 160, 162 in either variation of the integrated sprayer 152, 154 can be selectively operated by the controller as determined by the controller and the phase of the cycle. Operative control of the nozzles 160, 162 can be determined by any suitable method, such as with a slidable element as disclosed in U.S. patent application Ser. No. 13/941,898 filed on Jul. 15, 2013, which is incorporated by reference. Other non-limiting examples include an internal valve system or a sequential nozzle system, each of which can selectively control the supply of liquid to the nozzles.

Additionally, the supply tube 48 can couple to an incremental motor 168, included with the integrated sprayers 152, 154. The incremental motor 168 communicatively couples to the controller 60 for controlling operation of the integrated sprayers 152, 154, such as incremental timing or spacing, which can vary based upon distance between the integrated sprayers 152, 154 and the rack 24, 26 or dishes disposed thereon. In operation, the incremental motor 168 can rotate the sprayers 152, 154 in a controlled manner, allowing the sprayers 152, 154 to fully or freely rotate during a wash and rinse phase, but can control the sprayers 152, 154 during a high-speed spray phase. The controlled sprayers 152, 154, for example, can rotate in 45-degree increments such that the high-speed spray 166 covers the entire area of the upper 24 or lower 26 racks, effectively treating all dishes containing puddled liquid.

In alternative dishwashers 150, any number or combination of sprayers can utilize the integrated sprayers 152, 154. In a non-limiting example, only the upper-level sprayer can utilize the integrated sprayer, permitting high-speed spray directed toward the top of dishes carried in only the upper rack. The mid-level and lower sprayers can be normal sprayers and can be utilized in normal spray phases.

It should be understood that the integrated sprayers 152, 154 can provide for removal of puddled liquid from dishes, without requiring the installation of additional sprayers. Thus, the integrated sprayers 152, 154 can achieve removal of the puddled liquid without sacrificing space within the dishwasher 150, and minimizing costs.

Figure 10:
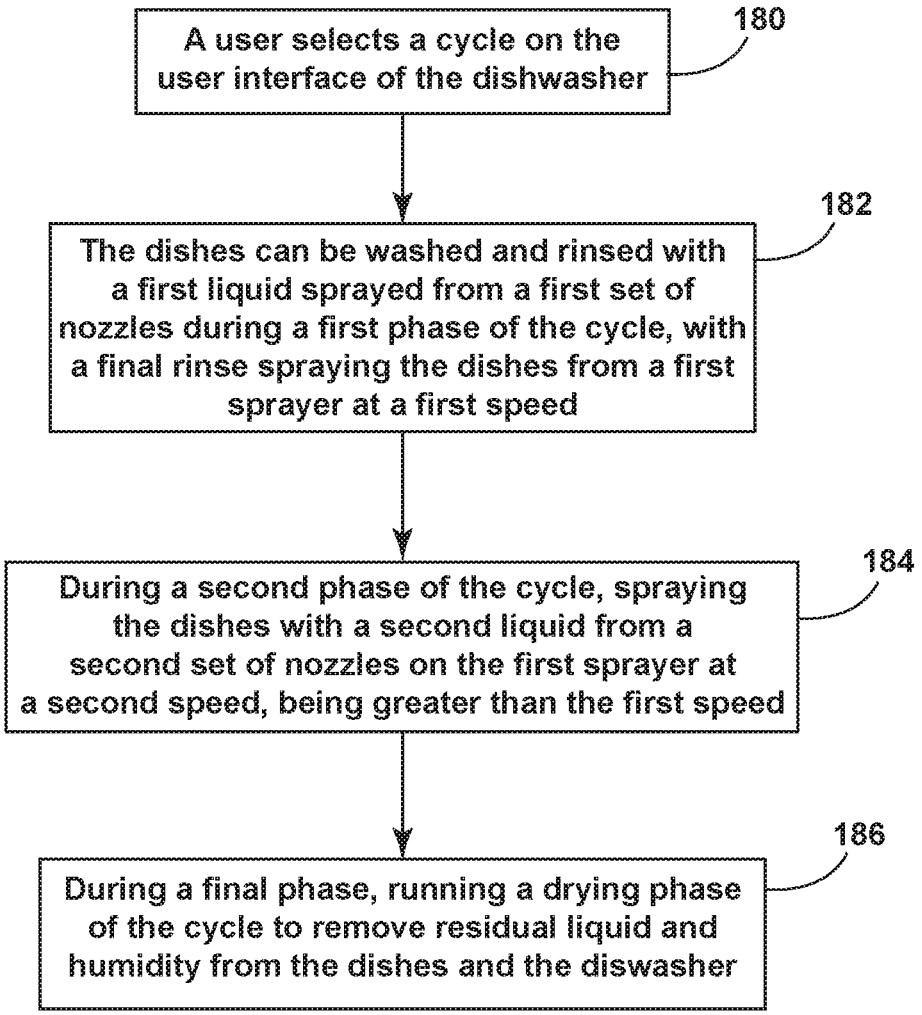
FIG. 10 illustrates a flow chart of a method of treating dishes.

Turning to FIG. 10, a flow chart illustrates another method of treating dishes according to cycle of operation in a dishwasher having a treating chamber in which is located a dish rack, upon which the dishes are received for treatment. At 180, a user selects a cycle of operation on the user interface 62 of the dishwasher 150. The controller 60 operates the dishwasher 150 according to the cycle selection, generally including one or more of wash, rinse, high-speed spray, and dry phases in non-limiting examples.

At 182, one or more first sprayers can wash and rinse the dishes during a first phase of the cycle. The first sprayer can include the normal sprayers 28, 30, 32, 34, or can include one of the integrated sprayers 152, 154 spraying the normal-speed spray 164 from the normal nozzles 160. At the end of the first phase, the dishes can be sprayed by the first sprayer, which can be the integrated sprayer 152, 154 at a first speed, being the normal-speed spray 164. In the integrated sprayer example 152, 154, the high-speed nozzles 162 can be closed or turned off and are not be operable during the first phase of the cycle. Any dishes having a concavity tend to collect liquid from the normal-speed spray 164, developing puddled liquid in the concavity.

At 184, a second phase of the cycle begins spraying a high-speed spray 166 from the first sprayer. The high-speed nozzles 162 disposed along the integrated sprayer 152, 154 can be opened while the normal-speed nozzles 160 can be closed, for example, by an internal valve system. The integrated sprayer 152, 154 sprays liquid from the high-speed nozzles 162 at a greater speed than the speed of the normal nozzles 160 during the first phase. The high-speed spray 166 blasts the puddled liquid from the concavities on the dishes, removing a significant portion of the puddled liquid from the dishes.

At 186, during a final phase, the dishwasher can utilize a heater to remove residual liquid and humidity from the dishes and the concavities thereon. As is appreciated, the residual liquid in the concavities is capable of removal with a standard dry phase utilizing a standard heater, normally incapable of removing a significant volume of puddled liquid in the concavities.

In further variations, any of the three separate dishwashers 10, 98, 150 having differing high-speed sprayers 36, 106, 152, 154 can be utilized in combination with or without one another and with other sprayers 28, 30, 32, 34. In one exemplary variation, the mid-level sprayer 32 can be an integrated sprayer 152 as described in FIG. 9 for spraying puddled liquid on dishes on the lower rack while the high-speed sprayer 36 of FIG. 1 can spray puddled liquid on dishes on the upper rack. As is appreciated, any combination of high-speed sprayer 36, dedicated sprayers 106, or integrated sprayers 152, 154 can be used in conjunction with standard sprayers or other high-speed sprayers such that dishes with puddled liquid can be treated and dried.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of reducing puddles on dishes according to a cycle of operation in a dishwasher having a treating chamber in which is located a dish rack on which the dishes are received for treatment, the method comprising:

emitting a first liquid from a sprayer above the dish rack at a first speed to form a normal-speed spray during a first phase of the cycle of operation to form puddles of wash liquid on the dishes in the dish rack; and providing a separate sprayer comprising a plurality of nozzles; emitting a second liquid from the separate sprayer located above the dish rack at a second speed, greater than the first speed, to form a high-speed spray on the dishes in the dish rack during a second phase of the cycle of operation where the high-speed spray at least partially removes a quantity of the puddles to decrease a volume of the puddles the wash liquid on the dishes in the dish rack; and increasing or decreasing diameters of the plurality of nozzles of the separate sprayer to vary a velocity of the high-speed spray based on dish height of the dishes in the dish rack.

2. The method of claim 1 wherein the first and second liquids comprise water.

3. The method of claim 1 wherein the dish rack has a bottom that defines an effective plane and the high-speed spray has a spray direction that directly sprays the dishes forming an acute angle relative to the effective plane.

4. The method of claim 1 wherein the velocity of the high-speed spray is 1.5-2.5 meters per second.

5. The method of claim 1 wherein the high-speed spray sprays an entirety of the dish rack.

6. The method of claim 1, further including drying the dishes with a drying phase where the drying phase would be incapable of removing an entire volume of the puddles of wash liquid prior to emitting the second liquid to remove a quantity of the puddles to decrease a volume of the puddles.

7. The method of claim 2 wherein the first and second phases are non-overlapping.

8. The method of claim 3 wherein the acute angle blasts the puddles preventing residual liquid from the separate sprayer to leave puddles.

9. The method of claim 3 wherein forming the high-speed spray includes forming multiple high-speed sprays at varying angles.

10. The method of claim 9 wherein the varying angles ranges between 25 degrees and 60 degrees relative to an effective plane defined by the dish rack.

* * * * *